US005624354A

United States Patent [19]

Chen

[11] Patent Number: 5,624,354

[45] Date of Patent: Apr. 29, 1997

[54] STRIDING EXERCISER HAVING A RESISTIVE DEVICE

[76] Inventor: Paul Chen, 5 F., No. 31, Gan Tzou 2nd Street, Shi Tun Chu, Taichung, Taiwan

[21] Appl. No.: 694,761

[22] Filed: Aug. 9, 1996

[51] Int. Cl.[6] ..... A63B 22/00

[52] U.S. Cl. ..... 482/51; 434/255

[58] Field of Search ..... 482/51, 52, 54, 482/70, 111, 112, 125; 434/247, 255; 601/33, 35

[56] References Cited

U.S. PATENT DOCUMENTS 4,940,233 7/1990 Bull et al. ..... 482/51
5,000,443 3/1991 Dalebout et al. ..... 482/51
5,419,747 5/1995 Piaget et al. ..... 482/51
5,496,235 3/1996 Stevens ..... 434/255
5,527,251 6/1996 Davis ..... 482/51
5,536,224 7/1996 Hsieh ..... 482/70

*Primary Examiner*—Stephen R. Crow
*Attorney, Agent, or Firm*—Charles E. Baxley, Esq.

[57] ABSTRACT

A striding exerciser includes a frame secured on a base and a rod rotatably secured to the frame. Two posts are pivotally coupled to the base and coupled to the rod by links and levers such that the rod may be rotated in a reciprocating rotational movement when the posts are moved forward and rearward in a reciprocating action. A housing is secured to the frame. A block is slidably engaged in the housing and has a brake shoe secured to the bottom for engaging with the rod. A bolt is engaged with the housing for forcing the brake shoe to brake the rod.

5 Claims, 1 Drawing Sheet

STRIDING EXERCISER HAVING A RESISTIVE DEVICE

BACKGROUND OF THE INVENTION

1. Field of the Invention

The present invention relates to an exerciser, and more particularly to a striding exerciser having a resistive device.

2. Description of the Prior Art

Several typical striding exercisers have been developed U.S. Pat. No. 4,645,200 to Hix, U.S. Pat. No. 4,850,585 to Dalebout, and U.S. Pat. No. 5,000,443 to Dalebout et al. are three examples of the exercisers. However, some of the typical striding exercisers comprise a complicated configuration that may not be easily manufactured and assembled.

The present invention has arisen to mitigate and/or obviate the afore-described disadvantages of the conventional striding exercisers.

SUMMARY OF THE INVENTION

The primary objective of the present invention is to provide a striding exerciser having a resistive device for resisting the movement of the feet supports.

In accordance with one aspect of the invention, there is provided a striding exerciser comprising a base including an upper portion having a pair of pivot shafts provided in the upper portion and including a frame secured on the upper portion, a rod rotatably secured to the frame, the rod including a first end having a first lever secured thereto and extended upward therefrom and including a second end having a second lever secured thereto and extended downward therefore, a pair of posts each including a middle portion pivotally coupled to the base at the pivot shaft so as to allow the posts to be rotated about the pivot shafts respectively, the posts each including an upper portion having a handle and each including a lower portion having a foot support, a first link and a second link pivotally coupling the posts to the first and the second levers respectively so as to couple the posts together, the rod being rotated in a reciprocating rotational movement when the posts are moved forward and rearward in a reciprocating action, and means for applying a resistance force against the rod and for resisting the rotational movement of the rod.

The resistance applying means includes a housing secured to the frame, the housing includes an interior and includes an upper portion having a screw hole formed therein, a bolt is threadedly engaged with the screw hole of the housing, a block is slidably engaged in the interior of the housing and includes a bottom portion having a brake shoe secured thereto for engaging with the rod and for braking the rod, and the block includes an upper portion for engaging with the bolt and for being moved toward the rod by the bolt.

A resilient pad and a metal plate are engaged between the block and the bolt for providing a resilient force to the block.

A bracket includes an upper portion secured to the housing and is engaged below the rod for preventing the rod from bending downward.

The bracket includes a brake shoe secured therein for engaging with the rod and for resisting the rotational movement of the rod.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
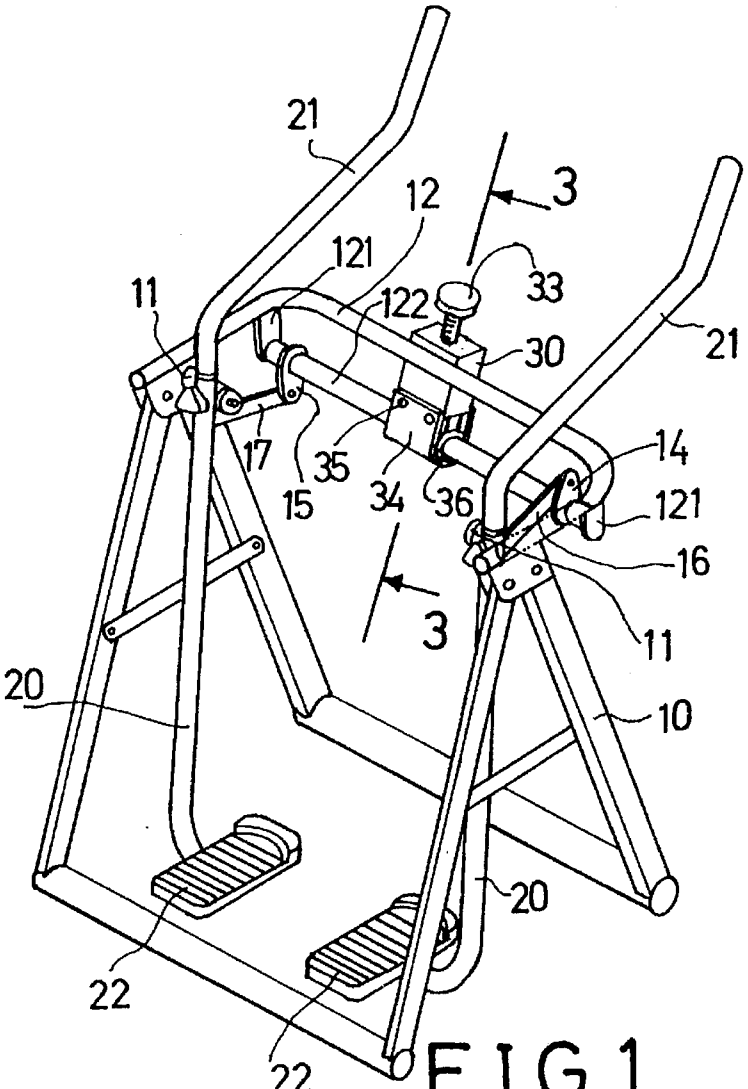
FIG. 1 is a front perspective view of a striding exerciser in accordance with the present invention.

Referring to the drawings, and initially to FIG. 1, a striding exerciser in accordance with the present invention comprises a base 10 including an upper portion having a pair of pivot shafts 11 provided therein and including a frame 12 secured on top thereof. The frame 12 includes a pair of ears 121 extended downward therefrom for rotatably supporting a rod 122. The rod 122 includes one end having a lever 14 secured thereto and extended upward therefrom and includes the other end having another lever 15 secured thereto and extended downward therefrom. A pair of posts 20 include a middle portion pivotally coupled to the base 10 at the pivot shafts 11 such that the posts 20 are rotatable about the pivot shafts 11. The posts 20 each includes a handle 21 provided on top thereof and each includes a foot support 22 provided on the bottom thereof. A pair of links 16, 17 pivotally couple the posts 20 to the levers 14, 15 respectively such that the posts 20 are coupled together by the links 16, 17 and the levers 14, 15 and the rod 122. One embodiment of the striding exerciser has been filed on Apr. 29, 1996, the serial number is 08/638,736. The co-pending U.S. patent application is taken as a reference for the present invention.

In operation, the rod 122 may be rotated in a reciprocating action by the levers 14, 15 and the links 16, 17 when when the posts 20 are moved forward and rearward in a reciprocating actions.

Figure 3:
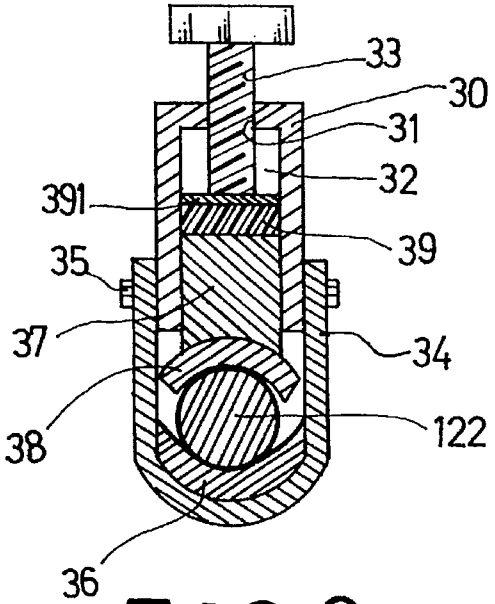
FIG. 3 is a cross sectional view taken along lines 3—3 of FIG. 1.
Figure 2:
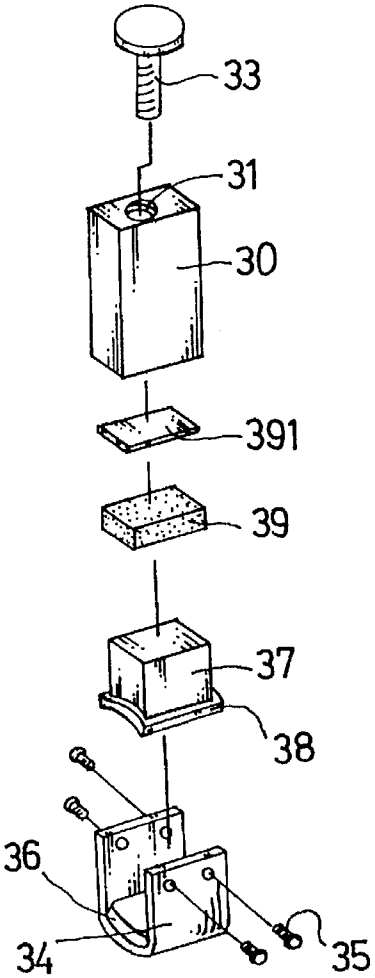
FIG. 2 is an exploded view of the resistive device.

The striding exerciser in accordance with the present invention further comprises a resistive device for resisting the rotational movement of the rod 122. As shown in FIGS. 1 to 3, the resistive device includes a housing 30 secured to the frame 12 by such as welding process. The housing 30 includes a hollow interior 32 and includes a screw hole 31 formed in the upper portion for engaging with a bolt 33. A bracket 34 engaged below the rod 122 and includes an upper portion secured to the housing 30 by fastening screws 35. It is preferable that the bracket 34 includes a brake shoe 36 secured therein for engaging with the rod 122. A block 37 is slidably engaged in the interior 32 of the housing 30 and includes a brake shoe 38 secured to the bottom thereof for engaging with the rod 122 and for braking the rod 122. A resilient pad 39 and a metal plate 391 are engaged on the block 37 and engaged with the bolt 33 for providing a resilient force and a slightly deformable structure between the block 37 and the bolt 33.

In operation, the brake shoe 38 of the block 37 may be forced toward the rod 122 in order to engage with and to brake the rod 122 such that the user have to spend more energy to overcome the resistance force applied to the rod. The resistance force applied onto the rod 122 may be adjusted by the threading movement of the bolt 33 relative to the housing 30. It is to he noted that the rod 122 may probably be bent after usage. The bracket 34 is provided for engaging will the rod 122 and for limiting the downward bending movement of the rod 122. When the rod 122 includes an excellent stiffness, the bracket 34 is no longer required. The brake shoe 38 of the block 37 is good enough for braking the rod 122.

Accordingly, the striding exerciser in accordance with tire present invention includes a simplified configuration that is excellent for manufacturing and assembling purposes. The brake shoe 38 may apply a resistance force against the rod 122.

Although this invention has been described with a certain degree of particularity, it is to be understood that the present disclosure has been made by way of example only and that humorous changes in the detailed construction and the combination and arrangement of parts may be resorted to without departing from the spirit and scope of the invention as hereinafter claimed.

I claim:

1. A striding exerciser comprising:

a base including an upper portion having a pair of pivot shafts provided in said upper portion and including a frame secured on said upper portion, a rod rotatably secured to said frame, said rod including a first end having a first lever secured thereto and extended upward therefrom and including a second end having a second lever secured thereto and extended downward therefrom, a pair of posts each including a middle portion pivotally coupled to said base at said pivot shaft so as to allow said posts to be rotated about said pivot shafts respectively, said posts each including an upper portion having a handle and each including a lower portion having a foot support, a first link and a second link pivotally coupling said posts to said first and said second levers respectively so as to couple said posts together, said rod being rotated in a reciprocating rotational movement when said posts are moved forward and rearward in a reciprocating action, and means for applying a resistance force against said rod and for resisting the rotational movement of said rod.

2. A striding exerciser according to claim 1, wherein said resistance applying means includes a housing secured to said frame, said housing includes an interior and includes an upper portion having a screw hole formed therein, a bolt is threadedly engaged with said screw hole of said housing, a block is slidably engaged in said interior of said housing and includes a bottom portion having a brake shoe secured thereto for engaging with said rod and for braking said rod, and said block includes an upper portion for engaging with said bolt anti for being moved toward said rod by said bolt.

3. A striding exerciser according to claim 2 further comprising a resilient pad and a metal plate engaged between said block and said bolt for providing a resilient force to said block.

4. A striding exerciser according to claim 2 further comprising a bracket including an upper portion secured to said housing, said bracket being engaged below said rod for preventing said rod from bending downward.

5. A striding exerciser according to claim 4 wherein said bracket includes a brake shoe secured therein for engaging with said rod and for resisting the rotational movement of said rod.

* * * * *